US005552562A

United States Patent [19]

Hertz et al.

[11] Patent Number: 5,552,562

[45] Date of Patent: Sep. 3, 1996

[54] INERTIAL ACOUSTIC PICKUP

[75] Inventors: Allen D. Hertz, Boca Raton; John M. McKee, Hillsboro Beach; Charles W. Mooney, Lake Worth; Irving H. Holden, Boca Raton; Gerald E. Brinkley, West Palm Beach, all of Fla.

[73] Assignee: Motorola, Inc., Schaumburg, Ill.

[21] Appl. No.: 297,341

[22] Filed: Aug. 29, 1994

[51] Int. Cl.[6] ..... G10H 3/18

[52] U.S. Cl. ..... 84/726; 84/727

[58] Field of Search ..... 84/725–8

[56] References Cited

U.S. PATENT DOCUMENTS 4,364,295 12/1982 Stich ..... 84/726
5,327,120 7/1994 McKee et al. .

OTHER PUBLICATIONS

*ITT Reference Data for Radio Engineers*, Howard W. Sams & Co., Inc., Indianapolis, Indiana, Electroacoustics p. 37–23.

*Primary Examiner*—Stanley J. Witkowski
*Attorney, Agent, or Firm*—Philip P. Macnak

[57] ABSTRACT

An inertial acoustic pickup (300) for use with a string musical instrument (700) having a soundboard (702) for delivering acoustic energy, comprises a chassis (302) including a coil (304) coupled to the soundboard (702), an armature including upper and lower substantially parallel planar suspension members (310) having planar perimeter regions (308) coupled to the chassis (302), and comprising a plurality of independent planar circular non-linear spring members (312) arranged regularly about a central planar region (314) within the planar perimeter region (305), an inertial mass (316) suspended between the upper and lower planar suspension members (310) about the central planar region (314) and having an axis (342) extending therebetween and including a plurality of permanent magnets (320) arranged regularly about a perimeter of the inertial mass (316), whereby acoustic energy coupled to the chassis (302) from the soundboard (702) is transformed through the planar non-linear spring members (312) into motional energy generated in a direction parallel to the axis (342) of the inertial mass (316) thereby generating an audio output signal in response to movement of the plurality of magnets (320) within the coil (304).

20 Claims, 5 Drawing Sheets

INERTIAL ACOUSTIC PICKUP

CROSS REFERENCE TO RELATED CO-PENDING APPLICATIONS

Related, co-pending applications include patent application Ser. No. 08/297,730 filed concurrently herewith, by Mooney, et al., entitled "Dual Mode Transducer for a Portable Receiver" and patent application Ser. No. 08/297,443, filed concurrently herewith, by McKee, et al., entitled "Mass Excited Acoustic Device", both of which are assigned to the Assignee hereof.

FIELD OF THE INVENTION

This invention relates in general to electromagnetic pickup devices, and more specifically to a inertial acoustic pickup for use with a device which generates acoustic energy, such as a string musical instrument.

BACKGROUND OF THE INVENTION

There are numerous acoustic pickup devices which are available in the market today for application to devices which generates acoustic energy, such as string musical instruments, as well as for other applications, such as devices which are subjected to acceleration, deceleration and vibration. The most commonly used acoustic pickup devices include electromagnetic pickup devices which are coupled to the strings of the musical instrument, and piezoelectric pickup devices, which are coupled to the musical instrument soundboard. Within the electromagnetic category of acoustic pickup devices, there are further numerous makes and models which are available which offer various features, such as providing adjustment for the string diameter and dual pickups such as used for hum cancellation. All the acoustic pickup devices, either electromagnetic or piezoelectric have had to rely on electronic preamplifiers and tone controls to provide the audio output quality suited to the needs of the musical instrument and the musical instrument user.

What is therefore needed is an acoustic pickup device which can be readily manufactured to enhance the various tonal qualities of a wide variety of string musical instruments, as well as to be easily adapted for use with other devices which generate acoustic energy.

SUMMARY OF THE INVENTION

In a preferred embodiment of the present invention a inertial acoustic pickup for use with a string musical instrument having a soundboard for delivering acoustic energy comprises a chassis including a coil and coupled to the soundboard; an armature including upper and lower substantially parallel planar suspension members having planar perimeter regions coupled to the chassis, the planar suspension members comprising a plurality of independent planar circular non-linear spring members arranged regularly about a central planar region within the planar perimeter region; an inertial mass suspended between the upper and lower planar suspension members about the central planar region and having an axis extending between the upper and lower planar suspension members; and a plurality of permanent magnets coupled to and arranged regularly about a perimeter of the inertial mass, whereby acoustic energy coupled to the chassis from the soundboard is transformed through the planar non-linear spring members into motional energy generated in a direction parallel to the axis of the inertial mass thereby generating an audio output signal in response to movement of the plurality of magnets within the coil.

In an alternate embodiment of the present invention, a inertial acoustic pickup system comprises a string musical instrument having a soundboard for delivering acoustic energy; and a inertial acoustic pickup which comprises a chassis including a coil and coupled to the soundboard; an armature including upper and lower substantially parallel planar suspension members having ;planar perimeter regions coupled to the chassis, the planar suspension members comprising a plurality of independent planar circular non-linear spring members arranged regularly about a central planar region within the planar perimeter region; an inertial mass suspended between: the upper and lower planar suspension members about the central planar region and having an axis extending between the upper and lower planar suspension members; and a plurality of permanent magnets coupled to and arranged regularly about a perimeter of the inertial mass, whereby acoustic energy coupled to the chassis from the soundboard is transformed through the planar non-linear spring members into motional energy generated in a direction parallel to the axis of the inertial mass thereby generating an audio output signal in response to movement of the plurality of magnets within the coil.

DESCRIPTION OF THE PREFERRED EMBODIMENT

Figure 1:
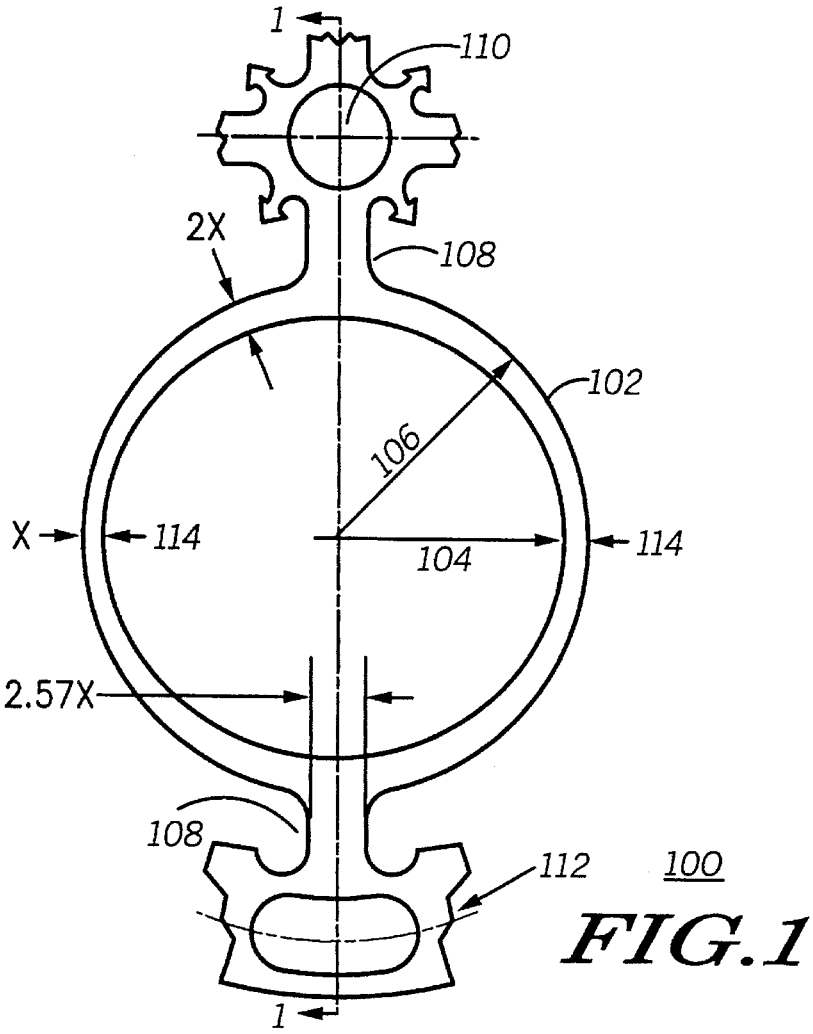
FIG. 1 is a top view of a planar non-linear spring member which is utilized in a inertial acoustic pickup in accordance with the preferred embodiment of the present invention.

With reference to FIG. 1, there is shown a top view of a planar non-linear spring member 100 utilized in a inertial acoustic pickup in accordance with the preferred embodiment of the present invention. The planar non-linear spring member 100 has a planar, substantially circular spring member 102 having in one embodiment a circular inner diameter 104 and a circular outer diameter 106, and in an improved embodiment an elliptical inner diameter 104 and a circular outer diameter 106, as shown in FIG. 1.

The improved embodiment Of the planar non-linear spring member 100 shown in FIG. 1 provides a spring member having a nonuniform width, the width "2X" being the widest in the region contiguous to the end restraints 108, and tapering to a width "X" about the midpoints 114 of the substantially circular planar spring members 102. The circular spring members 102 couple through end restraints 108 of substantially uniform width "2.57X" to a central planar region 110 and to a planar perimeter region 112.

Figure 2:
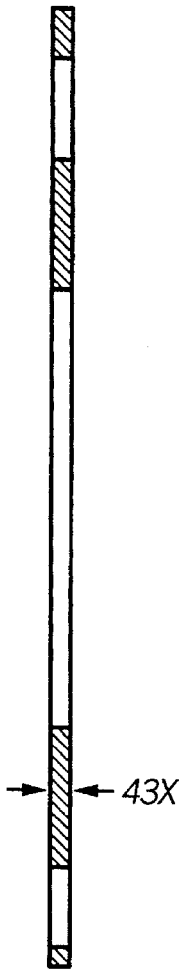
FIG. 2 is a cross-sectional view taken along line 1—1 of FIG. 1.

FIG. 2 is a cross-sectional view taken along line 1—1 of FIG. 1. As shown, the thickness of the improved planar non-linear spring member 100 is by way of example "0.43X". It Will be appreciated that the dimension and thickness of the planar non-linear spring member 100 affects the resonant frequency at which the inertial acoustic pickup 300 resonates, and can be changed to accommodate different operating frequency ranges, such as are required to provide optimal inertial acoustic pickups for a wide variety of devices generating acoustic energy, including string musical instruments, such as, but not limited to guitars, violins, violas, string bases, mandolins, autoharps, etc.

Figure 3:
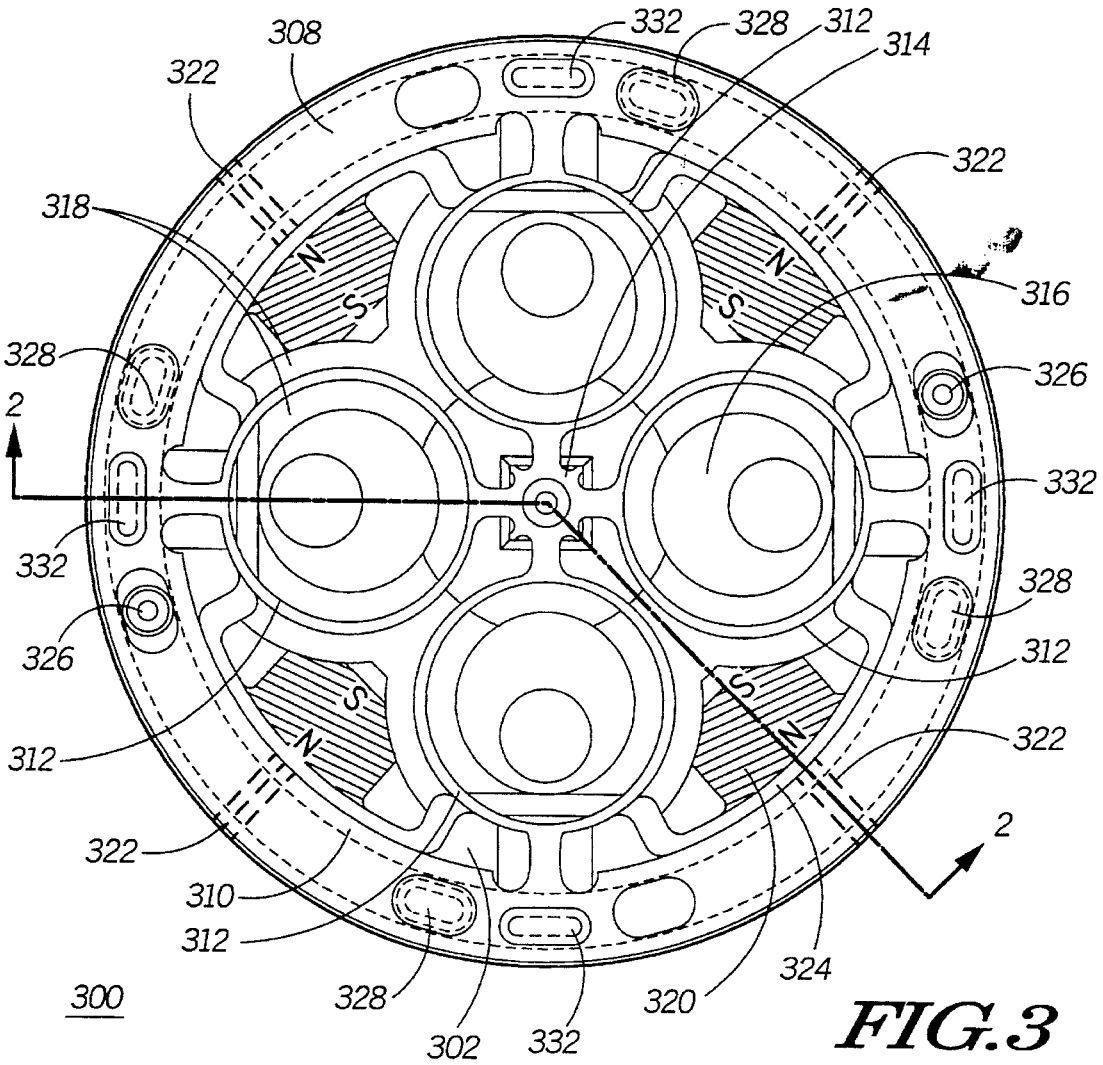
FIG. 3 is an orthogonal top view of the inertial acoustic pickup in accordance with the preferred embodiment of the present invention.
Figure 4:
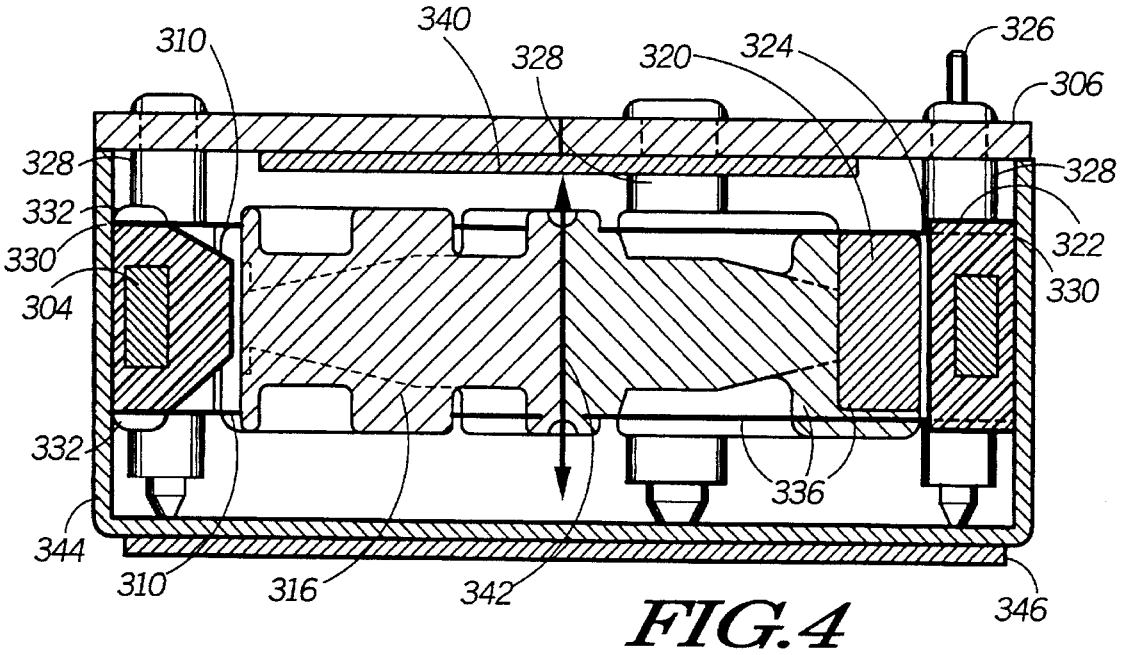
FIG. 4 is a cross-sectional view taken along the line 2—2 of the inertial acoustic pickup of FIG. 3.

FIG. 3 is an orthogonal top view of a inertial acoustic pickup 300 (with circuit board 306, shown in FIG. 4, removed). Shown in FIG. 3 is a coil form 302 which functions as a chassis, and which by way of example is approximately 0.7 inch (17.78 mm) in diameter and which encloses an electromagnetic coil 304 (FIG. 4) which functions as a signal generator for generating an audio signal in response to the movement of a number of magnets 320 within the electromagnetic coil 304, as will be described in detail below. The coil form 302 is manufactured using conventional double shot injection molding techniques using a plastic material, such as a thirty-percent glass-filled liquid crystal polymer which fully encloses the coil 304 except for terminals 326 which provide electrical connection to the coil 304. It will be appreciated that other plastic materials can be utilized for the coil form 302, as well as other configurations for the coil form 302, such as a bobbin supporting the coil, and an unenclosed wound coil impregnated with an epoxy material to provide structural rigidity. The coil form 302 establishes two planar perimeter seating surfaces 330 (FIG. 4) about a planar perimeter region 308 on which two planar suspension members 310 (an upper and a lower) are supported, and further includes eight contiguously molded bosses 332 which are used to orient and affix the planar spring members 310 to the coil form 302 using a staking process, such as using heat or ultrasonics.

Each of the two planar suspension members 310 comprises four independent planar non-linear spring members 312 arranged regularly around a central planar region 314 which is used for positioning and fastening an inertial mass 316 to the two planar suspension members 310 also using a staking process. The planar non-linear spring members 312 are defined as having a circular outer perimeter and a circular or elliptical inner perimeter such as described in FIG. 1 above. The planar suspension members 310 are manufactured from a sheet metal, such as Sandvik™ 7C27M02 stainless martensitic chromium steel alloyed with molybdenum, or a 17-7 PH heat treated CH900 precipitation-hardened stainless steel. It will be appreciated that other materials can be utilized as well. The sheet metal thickness is preferably 0.002 inch (0.0508 mm) thick, and the planar suspension members are formed preferably by a chemical etching, or machining technique. The inertial mass 316 is manufactured using conventional die casting techniques using a Zamak 3 zinc die-cast alloy, although it will be appreciated that other materials can be utilized as well.

The arrangement of the parts of the inertial acoustic pickup 300 is such that the inertial mass 316 can be displaced upwards and downwards in a direction normal to the planes of the two planar suspension members 310, the displacement being restricted by a restoring force provided by the independent planar non-linear spring members 312 in response to the displacement. The inertial mass 316 is formed such that there are shaped channels 318 for allowing the inertial mass 316 to extend through and around the independent planar non-linear spring members 312 during extreme excursions of the inertial mass 316, thereby providing a greater mass to volume ratio for the inertial acoustic pickup 300 than would be possible without the shaped channels 318. The inertial mass 316 includes by way of example four radially polarized permanent magnets 320 arranged regularly around the perimeter of the inertial mass 316. The radially polarized permanent magnets 320 magnetically couple to the electromagnetic coil 304, and acoustic energy which is coupled from the soundboard to the chassis, or coil form 302 is transformed through the planar non-linear springs members 312 into motional energy which is generated in a direction parallel to the axis 342 of the inertial mass 316. This produces a displacement of the radially polarized permanent magnets 320 within the electromagnetic coil 304 which results in the generation of an audio output signal from the electromagnetic coil 304 which can be processed, such as by amplification, as will be described below.

The radially polarized permanent magnets 320 are manufactured using Samarium Cobalt having a preferable Maximum Energy Product of 28–33 and having a N-S radial orientation to produce a coercive force of 8K–11K Oersteds, although it will be appreciated that other magnetic materials such as Alnico™ can be utilized as well with a corresponding performance change with regard to the audio output signal amplitude being generated. The two planar suspension members 310, the inertial mass 316, and the four permanent magnets 320 comprise a resonant armature system 336 for the inertial acoustic pickup 300, and the resonant armature system 336 can be customized, as will be described below, for different string musical instruments, as well as other devices which generate an acoustical energy output.

An additional detail shown in FIG. 3 comprises four radial projections 322 projecting in a direction normal to each surface (top and bottom) of the coil form 302 for compressively engaging with the planar perimeter region 308 of the top planar suspension member 310. The projections 322 pre-load the planar perimeter region 308 after the planar suspension member 310 is attached to the surface of the coil form 302 using bosses 332 located on either side of each of the protrusions 322. The bosses 332 are staked using heat or ultrasonic energy to secure the planar suspensions members 310 to the planar perimeter region 308 of the coil form 302. The purpose of pre-loading is for preventing audible (high frequency) parasitic vibrations during operation of the inertial acoustic pickup 300.

With reference to FIG. 4, a cross-sectional view taken along the line 2—2 of the inertial acoustic pickup of FIG. 3 clearly shows an air gap 324. The air gap 324 surrounds the inertial mass 316 (partially shown), thus allowing the inertial mass 316 to move in a direction normal to the planes of the two planar suspension members 310. The coil form 302 and magnetic motional mass 336 are enclosed in a housing 344 which is formed preferably of metal, although it will be appreciated that other materials, such as thermoplastic materials which have been formed by such processes as injection molding can be utilized as well. An adhesive material 346, such as a high tack film adhesive is selectively applied to the housing 344, and provides a convenient means for attaching the inertial acoustic pickup to the soundboard. A protective film (not shown), such as a Teflon tape, can be applied to the adhesive to provide protection of the adhesive during shipping and handling.

Figure 5:
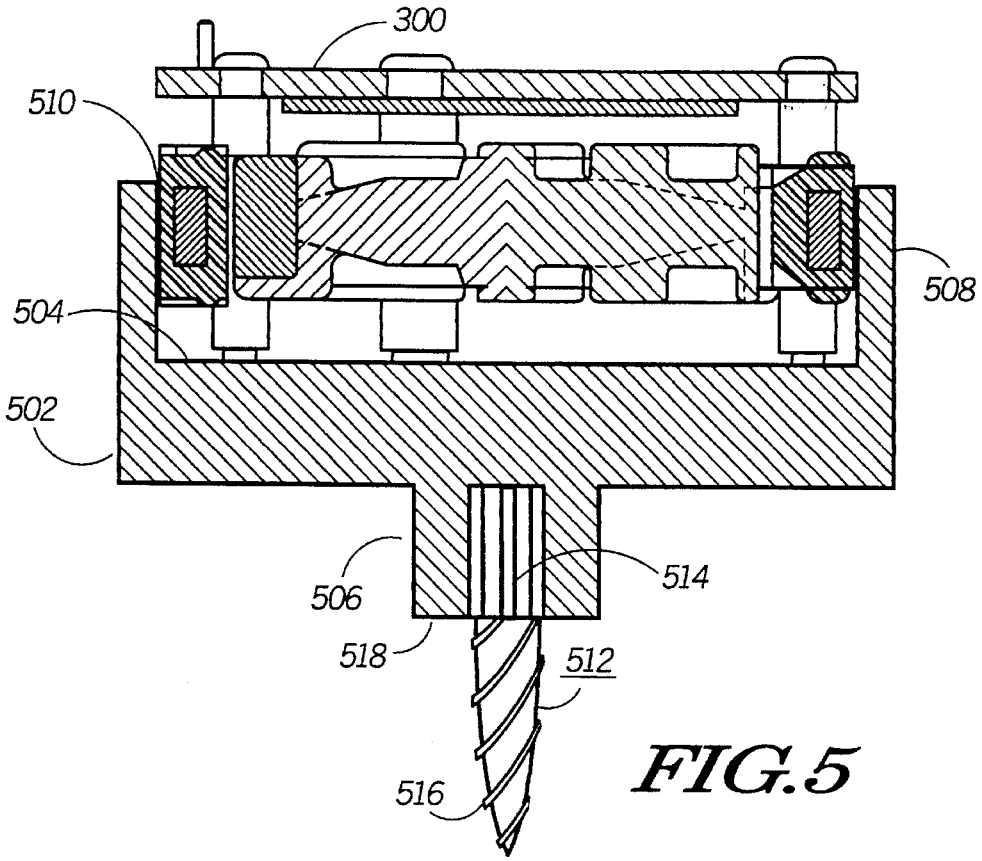
FIG. 5 is a cross-sectional view taken along the line 2—2 of the inertial acoustic pickup of FIG. 3 showing an alternate mounting approach.

FIG. 5 is a cross-sectional view taken along the line 2—2 of the inertial acoustic pickup 300 of FIG. 3 showing an alternate mounting approach. As shown, the inertial acoustic pickup 300 is positioned into a pedestal 502 which comprises a platform 504 and a foot 506 which are formed contiguous to each other. A ring 508 having a circular periphery is also formed contiguous to the surface of the platform 504 and is used to mount the inertial acoustic pickup 300 to the pedestal 502. The pedestal 502 is preferably formed using an injection molding process, and any of a number of thermoset plastic materials. The inertial acoustic pickup 300 is attached at the perimeter 510 of the coil form 308 to the ring 508 and is preferably held in place using an adhesive, such as a cyanoacrylate or epoxy adhesive. By way of example, the foot 506 is 0.145 inches (3.7 mm) in diameter which is substantially smaller than the 0.700 inch (17.8 mm) diameter of the platform 504. A threaded screw 512 has a first end 514 formed as a splined metallic rod and a second end 516 as a threaded rod with a wood screw taper. The foot 506 can be molded over the splined rod end 514 during the injection molding process described above, or can be ultrasonically staked into a cavity formed into the foot during the injection molding process. An adhesive material can be placed on the surface 518 of the foot 506 which contacts the soundboard to prevent the screw 516 from loosening due to any vibration and shock which is imparted to the string musical instrument either during playing or handling.

Figure 6:
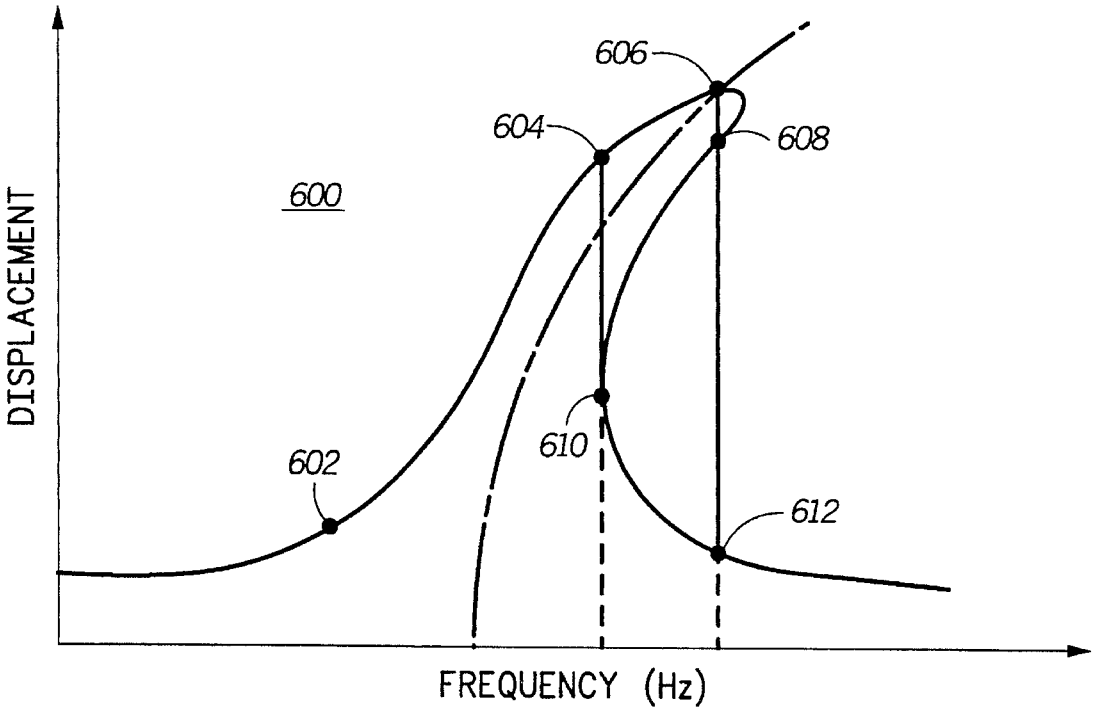
FIG. 6 is a graph 600 depicting the impulse output as a function of frequency for a inertial acoustic pickup utilizing a non-linear, hardening spring type resonant system when driven as a transducer.

FIG. 6 is a graph 600 depicting the impulse output as a function of frequency for a inertial acoustic pickup utilizing a non-linear, hardening spring type resonant system when driven as a transducer. As shown, the inertial acoustic pickup utilizing a non-linear, hardening spring type resonant system when driven by a Swept driving frequency operating between a first driving frequency provides a lower impulse output 602 and a second driving frequency provides an upper impulse output 604. The upper impulse output 604 is preferably selected to correspond substantially to the maximum driving frequency at which there is only a single stable operating state. As can be seen from FIG. 6, two stable operating states 604 and 610 are possible when the driving frequency is set to that required to obtain impulse output 610, and as the driving frequency is increased therefrom, three stable operating states can exist, such as shown by example as impulse outputs 606, 608 and 612. As will be described below, those impulse responses which lie on the curve 600 above the operating state 612 are suitable for providing audible responses as a transducer, and defines the minimum operating frequency limit as a inertial acoustic pickup for use with a string musical instrument or other device which generates an acoustic output. In addition, the response of the inertial acoustic pickup 300 to audio input energy at frequencies above the operating state 612 are enhanced by harmonic responses of the inertial acoustic pickup 300 at frequencies higher than operating state 612.

As was described above, each string musical instrument has a frequency range which they reproduce. Table I below lists typical frequency ranges for several typical string musical instruments:

TABLE I

| Instrument | Frequency Range |
|---|---|
| Bass Viol | 41.20 Hz–246.94 Hz |
| Cello | 65.41 Hz–698.46 Hz |
| Viola | 130.81 Hz–1174.70 Hz |
| Violin | 196.00 Hz–3136.00 Hz |

As was described above, the inertial acoustic pickup in accordance with the present invention can be customized as to operating characteristics as a pickup. By varying the size and thickness of the armature, which impacts the size of the parallel planar suspension members, a inertial acoustic pickup can be produced which has a single stable operating state 612 which lies below 41.20 Hz, thus providing a pickup suitable for use with a bass viol. Likewise, a inertial acoustic device can be produced which has a single stable operating state 612 which lies below 196.00 Hz, thus providing a pickup suitable for use with a violin.

Figure 7:
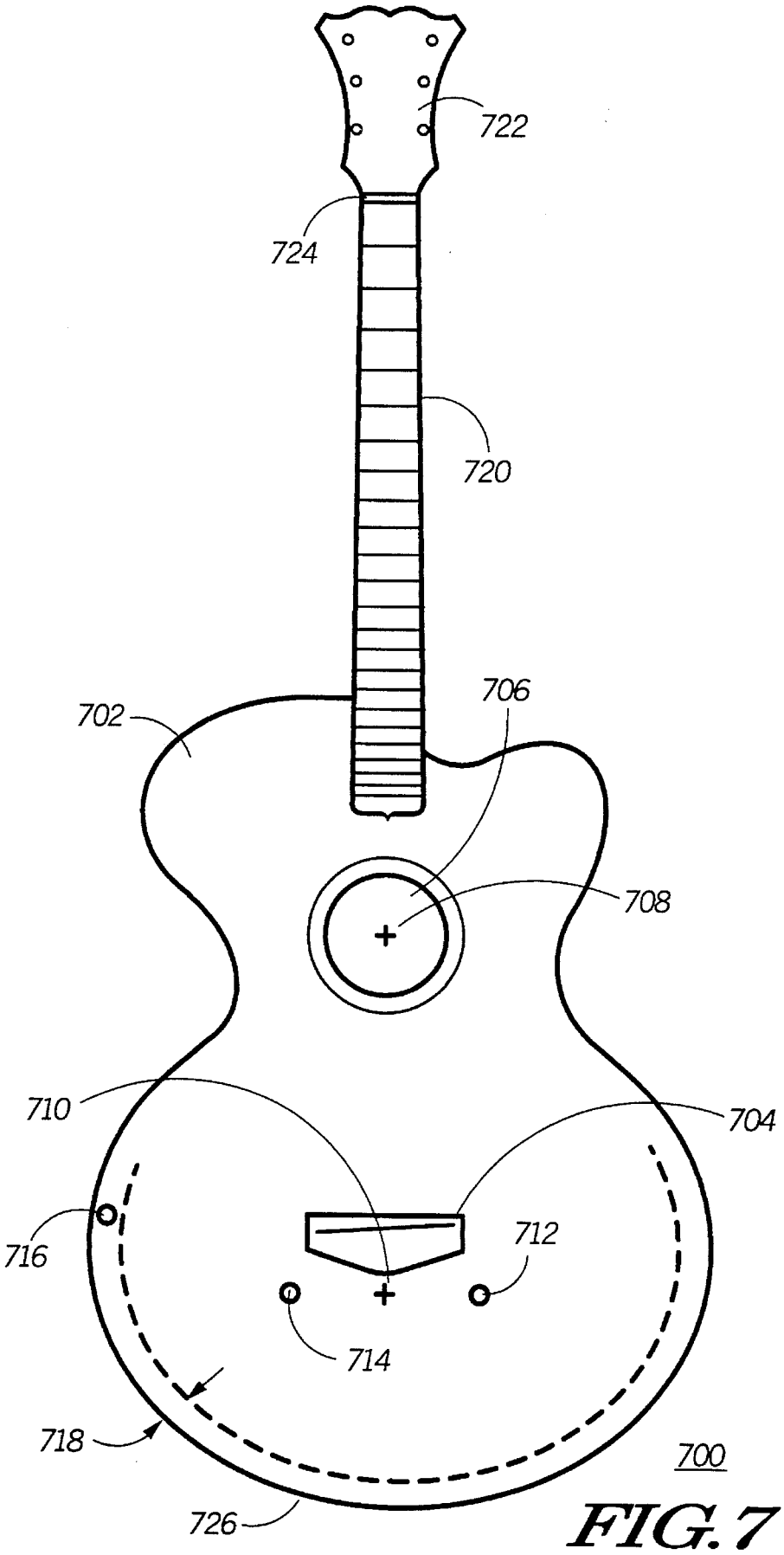
FIG. 7 is an orthogonal top view of a string musical instrument providing details related to utilizing the inertial acoustic pickup of FIG. 3.

FIG. 7 is an orthogonal top view of a string musical instrument providing details related to utilizing the inertial acoustic pickup of FIG. 3. A typical string musical instrument, such as guitar 700, is constructed having a body 726 to which is attached a neck having a fret board 720 (a finger board in a violin, and such), a nut 724 and a peg head 722. The top body plate is the soundboard 702 which includes a sound hole 708 (a pair of f holes in a violin and such) and to which a bridge 704 is attached. The soundboard 702 is resonant and exhibits different vibrational characteristics at different points about the soundboard 702. Positions 708 and 710 designate preferred mounting locations, while points 712 and 714 designate alternate mounting locations (tone weighted response). The areas within the soundboard 702, and in particular areas 710, 712 and 714 exhibit low frequency responses having high amplitudes, while those areas, such as area 716, which lies on the periphery of the soundboard exhibit high frequency, low amplitude responses. The peripheral area is typically a band 718 which is with 1" to 2" inches (25.4 to 50.8 mm) of the perimeter of the soundboard for a guitar. The preferred mounting locations 708 and 710 are those most commonly utilized for positioning an acoustic pickup device, such as the inertial acoustic pickup 300 in accordance with the present invention. When the preferred mounting location 708 is utilized, the pickup device is typically mounted in a manner which provides ease of removability at a later time. The preferred mounting location 710 and alternate mounting locations 712 and 714 are utilized by affixing the pickup to the underside of the soundboard using an adhesive interconnect as described in FIG. 4, above.

Figure 9:
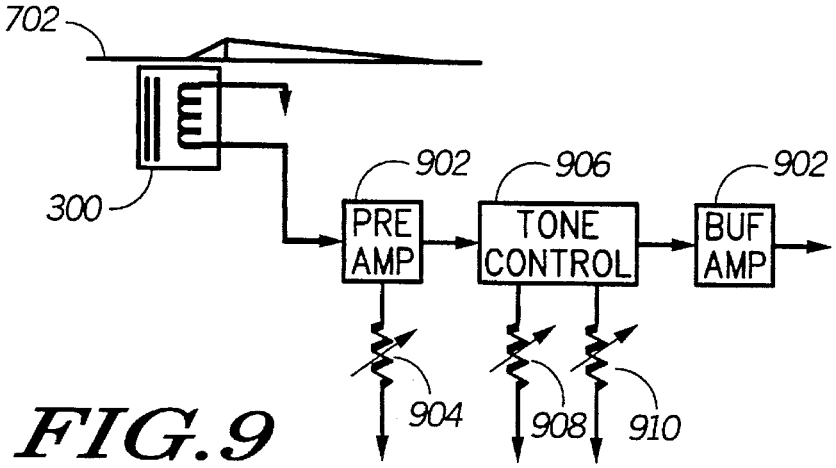
FIG. 9 is an electrical block diagram of a inertial acoustic pickup system in accordance with the preferred embodiment of the present invention.
Figure 8:
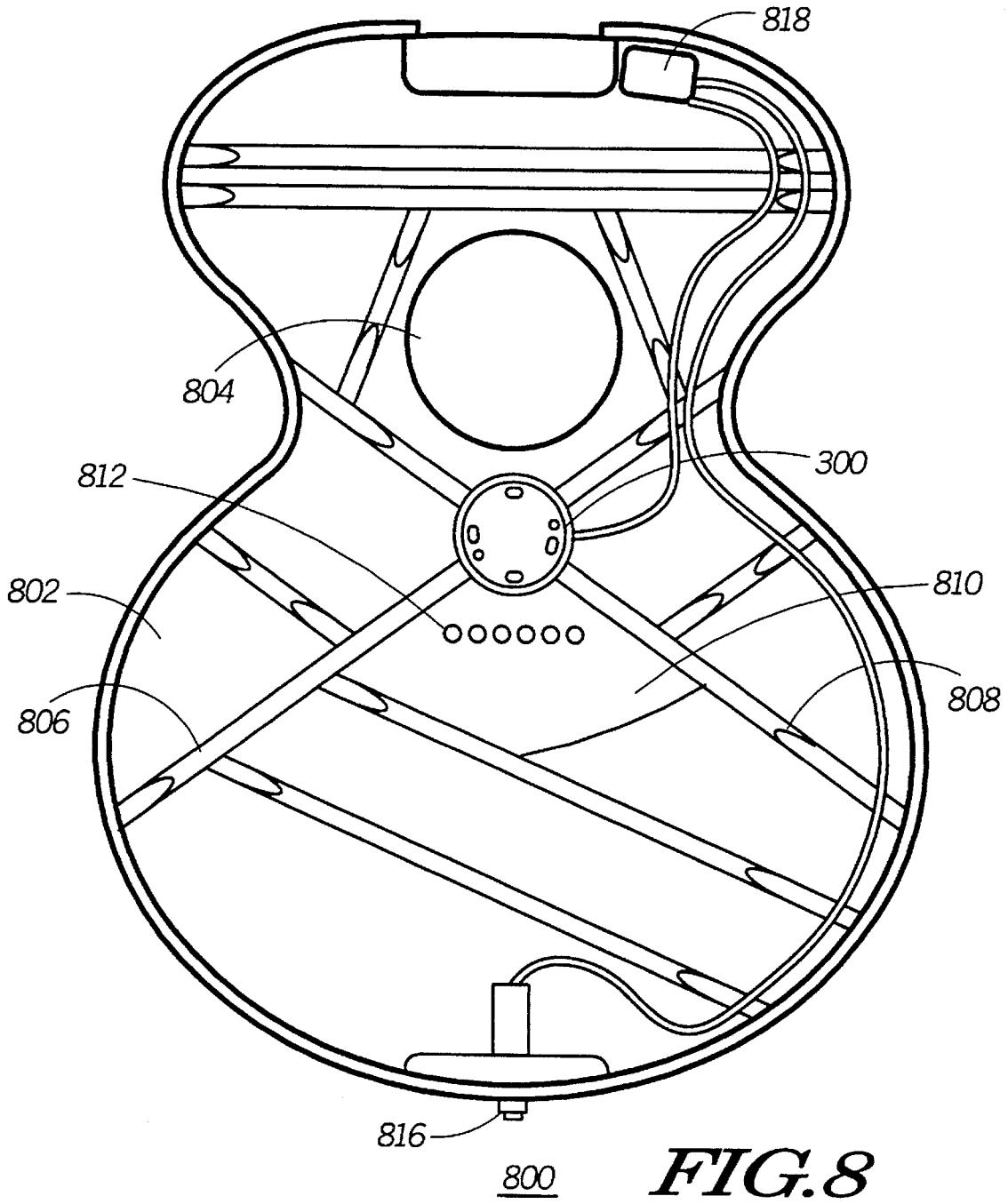
FIG. 8 is an orthogonal internal top view of a string musical instrument providing alternate details related to utilizing the inertial acoustic pickup of FIG. 3.

FIG. 8 is an orthogonal internal top view of a string musical instrument, in particular that of a guitar, providing alternate mounting details related to utilizing the inertial acoustic pickup of FIG. 3. As shown in FIG. 9, the soundboard 802 of a guitar includes a sound hole 804 and is braced, such as using the X-bracing pattern 806, 808 which is typical of a steel string acoustic guitar. Area 810 on the soundboard 802 is reinforced to provide rigidity to pegs 812 which secure the strings below the bridge. The inertial acoustic pickup 300 can be affixed directly to the soundboard in area 810 using an adhesive, or as shown, affixed to the X-bracing using an adhesive, or the alternate screw mounting method described in FIG. 5. The audio output from the inertial 2acoustic device 300 couples directly to a jack 816, or may couple indirectly after being processed by an internally mounted preamplifier 818.

FIG. 9 is an electrical block diagram of a inertial acoustic pickup system in accordance with the preferred embodiment of the present invention. The audio output of the inertial acoustic pickup 300 is coupled to the input of an audio preamplifier 902. The relative volume is controlled using a volume control 904. The amplified output of preamplifier 902 is preferably coupled to a tone control amplifier 906 which enables control of the frequency/amplitude characteristics of the audio signal. Tone control, such as 908 for bass boost/cut and 910 for treble boost/cut are provided to adjust the tone of the string musical instrument to suit the instrument players needs. The tone control amplifier output is then coupled to the input of a buffer amplifier 912 which provides the amplified and waveshaped, or equalized, audio signal at an output impedance suitable to drive an audio amplifier.

A inertial acoustic pickup has been described above which can be readily manufactured to enhance the various tonal qualities of a wide variety of string musical instruments. In particular, the inertial acoustic pickup 300 comprises, in part, two planar suspension members 310, an inertial mass 316, and four permanent magnets 320 which in combination comprise a resonant armature system 336 which are customizable, as described above, for different string musical instruments, as well as other devices which generate an acoustical energy output. The inertial acoustic pickup of the present invention utilizes planar non-linear spring members which transform acoustic energy generated by a soundboard into motional energy generated in a direction parallel to the axis of motion of the inertial mass which results in the generation of an audio output signal in response to the movement of the permanent magnets within a surrounding coil. By designing the inertial acoustic device to have a fundamental response below that of the acoustic energy generated by the string musical instrument, the inertial acoustic pickup 300 is suitable for use with any string musical instrument, or other device which generates acoustic energy.

We claim:

1. An inertial acoustic pickup for use with a device having a soundboard for delivering acoustic energy, comprising:

a chassis coupled to the soundboard and including a coil having first and second outputs for delivering an audio output signal to an external circuit;

an armature, including upper and lower planar suspension members having planar perimeter regions coupled to said chassis, said upper and lower planar suspension members comprising a plurality of independent planar non-linear spring members arranged regularly about a central planar region within said planar perimeter regions, said plurality of independent planar non-linear spring members being defined by members having maximum opposing widths which taper to minimum opposing widths at midpoints thereon, said maximum opposing widths being coupled to said central planar region and to said planar perimeter regions;

an inertial mass suspended between said upper and lower planar suspension members about said central planar region and having an axis extending therebetween; and a plurality of permanent magnets, coupled to and arranged regularly about a perimeter of said inertial mass, whereby acoustic energy coupled to said chassis from said soundboard is transformed through said plurality of independent planar non-linear spring members into motional energy generated in a direction parallel to said axis of said inertial mass thereby generating the audio output signal in response to movement of said plurality of magnets within said coil.

2. The inertial acoustic pickup according to claim 1 wherein said plurality of independent planar non-linear spring members are defined by circular outer perimeters and elliptical inner perimeters.

3. The inertial acoustic pickup in accordance with claim 2 wherein said maximum opposing widths which taper to minimum opposing widths at midpoints thereon are defined by spring members having an elliptical inner perimeter and a circular outer perimeter.

4. The inertial acoustic pickup in accordance with claim 1, wherein said maximum opposing widths are twice said minimum opposing widths.

5. The inertial acoustic pickup in accordance with claim 1 wherein said chassis and said planar perimeter regions of said armature have peripheries which are substantially circular.

6. The inertial acoustic pickup in accordance with claim 1 wherein said plurality of independent planar non-linear spring members are in tension during movement of said inertial mass.

7. The inertial acoustic pickup in accordance with claim 1, wherein said chassis is injection molded from a liquid crystal polymer material, and wherein said coil is enclosed within said liquid crystal polymer material.

8. The inertial acoustic pickup in accordance with claim 1 further comprising a housing coupled to said chassis for at least partially enclosing said chassis, said armature and said inertial mass.

9. The inertial acoustic pickup in accordance with claim 8, further comprising an adhesive, coupled to said housing, for affixing said housing to said soundboard.

10. An inertial acoustic pickup system, comprising:

a device having a soundboard for delivering acoustic energy; and an acoustic pickup, comprising a chassis coupled to the soundboard and including a coil having first and second outputs for delivering an audio output signal to an external circuit, an armature, including upper and lower planar suspension members having planar perimeter regions coupled to said chassis, said upper and lower planar suspension members comprising a plurality of independent planar non-linear spring members arranged regularly about a central planar region within said planar perimeter regions, said plurality of independent planar non-linear spring members being defined by members having maximum opposing widths which taper to minimum opposing widths at midpoints thereon, said maximum opposing widths being coupled to said central planar region and to said planar perimeter regions, an inertial mass suspended between said upper and lower planar suspension members about said central planar region having an axis extending therebetween, and a plurality of permanent magnets, coupled to and arranged regularly about a perimeter of said inertial mass, whereby acoustic energy coupled to said chassis from said soundboard is transformed through said plurality of independent planar non-linear spring members into motional energy generated in a direction parallel to said axis of said inertial mass thereby generating the audio output signal in response to movement of said plurality of magnets within said coil.

11. The inertial acoustic pickup system according to claim 10 wherein said plurality of independent planar non-linear spring members are defined by circular outer perimeters and elliptical inner perimeters.

12. The inertial acoustic pickup system in accordance with claim 11 wherein said maximum opposing widths which taper to minimum opposing widths at midpoints thereon are defined by spring members having an elliptical inner perimeter and a circular outer perimeter.

13. The inertial acoustic pickup system in accordance with claim 10, wherein said maximum opposing widths are twice said minimum opposing widths.

14. The inertial acoustic pickup system in accordance with claim 10 wherein said chassis and said planar perimeter regions of said armature have peripheries which are substantially circular.

15. The inertial acoustic pickup system in accordance with claim 10 further comprising:

a pedestal, comprising a platform, formed for mounting said acoustic pickup, and a foot, said platform and foot having an axis extending centrally there through, said foot being contiguous to said platform and separating said platform from said soundboard; and attachment means, coupled to said foot, for attaching said acoustic pickup to said soundboard.

16. The inertial acoustic pickup system in accordance with claim 15, wherein said attachment means comprises a wood screw.

17. The inertial acoustic pickup system in accordance with claim 15, wherein said attachment means comprises an adhesive.

18. The inertial acoustic pickup system in accordance with claim 15 wherein said foot is substantially smaller than said platform.

19. The inertial acoustic pickup system in accordance with claim 10 wherein said external circuit comprises an audio amplifier for amplifying the audio output signal generated.

20. The inertial acoustic pickup system in accordance with claim 19, wherein said audio amplifier further includes waveshaping means for equalizing the audio output signal generated over a predetermined frequency range.

* * * * *

UNITED STATES PATENT AND TRADEMARK OFFICE

CERTIFICATE OF CORRECTION

PATENT NO. : 5,552,562

DATED : September 3, 1996

INVENTOR(S) : Hertz et al.

It is certified that error appears in the above-indentified patent and that said Letters Patent is hereby corrected as shown below:

Claim 10, Column 8, Line 55, after planar region insert --and--.

Signed and Sealed this

Seventh Day of January, 1997

*Attest:*

Bruce Lehman

BRUCE LEHMAN

*Attesting Officer*

*Commissioner of Patents and Trademarks*